United States Patent [19]

Shalaev et al.

[11] 4,283,081

[45] Aug. 11, 1981

[54] LOCK FOR PORTABLE CONTAINER

[76] Inventors: Vitaly I. Shalaev, ulitsa Bairona, 161G, kv. 32; Alexandr K. Protasov, ulitsa Vladimira Konovalova, 43; Vladimir I. Vasiliev, ulitsa Bljukhera, 26, kv. 172; Viktor I. Ponomarev, ulitsa Gvardeitsev Sheronintsev, 69/42, kv. 37, all of, Kharkov, U.S.S.R.

[21] Appl. No.: 70,145

[22] Filed: Aug. 27, 1979

[51] Int. Cl.[3] ..... E05C 5/02

[52] U.S. Cl. ..... 292/113; 292/DIG. 49

[58] Field of Search ..... 292/113, 247, DIG. 49, 292/66

[56] References Cited

U.S. PATENT DOCUMENTS

| | | | |
|---|---|---|---|
| 2,893,771 | 7/1959 | Claud-Mantle | 292/113 |
| 3,519,298 | 7/1970 | Gley et al. | 292/113 |
| 4,184,705 | 1/1980 | Little | 292/247 |

FOREIGN PATENT DOCUMENTS

| | | | |
|---|---|---|---|
| 464691 | 6/1975 | U.S.S.R. | 292/247 |

*Primary Examiner*—Richard E. Moore

*Attorney, Agent, or Firm*—Robert E. Burns; Emmanuel J. Lobato; Bruce L. Adams

[57] ABSTRACT

According to the invention a lock for a portable container comprises a lug for being fixed on the body of the container, a latch having a hook-like end intended for engaging the cover of the container, a link connecting the latch with the lug, and a stirrup. The stirrup is introduced into longitudinal slots provided on the latch, said slots coinciding with a transverse groove provided on the lug when the lock is closed, due to which the stirrup enters the groove and fixes the latch, thereby preventing the latter from displacement relative to the lug.

6 Claims, 4 Drawing Figures

LOCK FOR PORTABLE CONTAINER

BACKGROUND OF THE INVENTION

1. Field of the Invention

The present invention relates to locks for portable containers and can be used, in particular, in containers intended for storing and transporting foodstuffs, medical preparations and chemical reagents, especially in the cases when spontaneous opening of these containers during their transportation should be avoided.

2. Description of the Prior Art

There is known a lock for a portable container having a body and a cover, comprising a lug to be fixed on the body of the container and a latch connected to this lug and having a hook-like end for engaging the cover of the container/cf. U.S. Pat. No. 2,872,066/. The latch is pressed against the cover of the container by a leaf spring fixed inside the container and engages with its hook-like end the flange of the cover.

For opening the container the latch is pulled outwardly to disengage its hook-like end and thereby release the cover. For closing the container the cover is positioned on the body thereof, in which case the cover presses with its flange on the hook-like end of the latch which in response moves outwardly and then under the action of the leaf spring engages the flange of the cover.

However, the construction of the above lock does not rule out spontaneous opening of the container, which may happen for different reasons including accidental mechanical action on the latch of the lock during transportation of the container. This is accounted for by the fact that the force pressing the latch to the cover of the container is not sufficient to hold it in place due to a relatively high ratio of the length of the latch arm between the latch end abutting against the body of the container and the hook-like end of the latch to the length of the latch arm between said end and the point whereto the pressing force of the spring is applied. Due to this the latch can be easily disengaged from the cover. For the same reason the latch at the place of its contact with the leaf spring is subjected to a high rate of wear.

SUMMARY OF THE INVENTION

The main object of the present invention is to provide such a lock for a portable container, which would provide for a high reliability of locking of the container.

Another object of the invention is to provide such a lock for a portable container, which would be convenient in operation.

An additional object of the invention is to provide a lock for a portable container, featuring a simple construction.

These and other objects of the invention are attained by that a lock for a portable container having a body and a cover, comprising a lug adapted for being fixed on the body of the container and a latch connected with the lug and having a hook-like end for engaging the cover of the container, according to the invention further includes a stirrup and a link connecting the latch with the lug by means of two parallel hinges, the latch having longitudinal slots into which the stirrup is introduced, and the lug having a transverse groove coinciding with the slots of the latch when the lock is closed, thereby letting the stirrup enter the groove and fix the latch.

Such construction prevents the latch from rotation relative to the lug since the stirrup connected with the latch and introduced into the groove on the lug serves as a stop preventing displacement of the latch. This rules out spontaneous opening of the lock during transportation of the container. Spontaneous disengagement of the stirrup from the groove on the lug can be prevented by any known in the art method. The simplest way to hold the stirrup in place is to connect it with a handle, in which case when carried by hand the container is suspended resting on the stirrup which under the action of the container weight is pressed against the surface of the groove.

It is expedient that the groove on the lug have a profile narrowing towards the cover of the container so that the stirrup is centered when being introduced into the groove, thereby fixing the relative positions of the lock components in a closed position and thus ensuring a high reliability of the lock.

It is also expedient to provide the lock with a resilient plate having one end fixed on the lug and the other end bent in a loop and introduced into the groove on the lug. The resilient plate will fix the stirrup in the groove on the lug, which permits the container to be carried not only in a suspended position but also resting on any suitable support.

It is advisable that the longitudinal dimensions of the stirrup and of the latch be so selected that the inner size of the stirrup would be smaller than the outer size of the latch by a value sufficient for the stirrup to engage the hook-like end of the latch with interference. This enables the stirrup to be fixed in the groove on the lug in a manner described above. In this case the stirrup can be also used for fixing a handle to the body of the container.

It is useful to provide the link at the side of the latch with a projection for the stirrup to rest on when the lock is open, which will rule out sinking of the latch behind the link, thereby preventing the latch from knocking against the container body and facilitating locking and unlocking the container.

The invention may be variously otherwise embodied, the preferred embodiment incorporating all the modifications disclosed above.

BRIEF DESCRIPTION OF THE DRAWINGS

The invention will now be explained with reference to embodiments thereof which are represented in the accompanying drawings in which.

DESCRIPTION OF THE PREFERRED EMBODIMENT OF THE INVENTION

Figure 2:
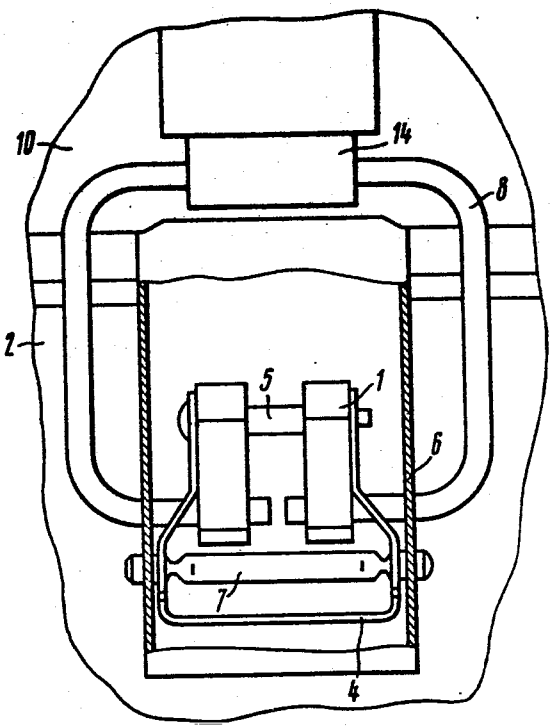
FIG. 2 is a front view with a partial section of the lock according to the invention.
Figure 1:
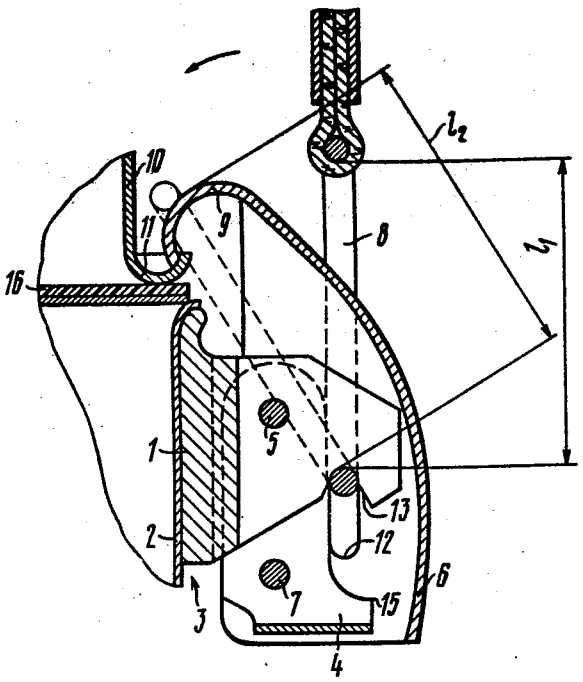
FIG. 1 is a cross-section of the lock for a portable container in a closed position /shown by an arrow is the stirrup movement for engaging the latch, shown in dot line is the stirrup engaging the latch, a handle is not shown/.

According to the invention a lock for a portable container comprises a lug 1 /FIGS. 1 and 2/ adapted for being fixed on the body 2 of a container 3, a link 4 connected with the lug 1 by means of a hinge or pivot 5, a latch 6 connected with the link 4 by means of a hinge or pivot 7, and a stirrup 8.

The axes of the hinges or pivots 5 and 7 are parallel with the parting plane of the container 3 and allow the latch 6 to be moved relative to the lug 1 in a plane perpendicular to the parting plane of the container 3. The latch 6 is provided with a hook-like end 9 intended for engaging the cover 10 of the container 3. To make the cover capable of being engaged by the hook-like end 9 it is provided with a flange 11.

The latch 6 has longitudinal slots 12 into which there is introduced the stirrup 8, and the lug 1 has a transverse notch or groove 13 coinciding with the slots 12, as shown in FIG. 1, so as to allow the stirrup 8 to enter the notch or groove 13 on the lug 1 when the lock is being closed.

To provide centering of the stirrup 8 in the groove 13 on the lug 1, said groove has a profile which narrows towards the cover of the container 3 as shown in FIG. 1.

The container 3 is provided with a handle made in the form of a belt 14 secured to the stirrup 8 as shown in FIG. 2.

For limiting outward movement of the latch 6 the link 4 has a projection 15 /FIG. 1/.

The cover 10 is positioned on the body 2 of the container 3, with sealing member 16 being disposed therebetween.

The proposed lock for a portable container is operated as follows. The hook-like end 9 of the latch 6 is caused to engage the flange 11 of the cover 10, and the link 4 is rotated about the axis of the hinge 5 by pressing on the lower portion of the latch 6 /FIG. 1/ until said link abutts against the base of the lug 1. In this case the slots 12 on the latch 6, wherein the stirrup 8 is introduced, coincide with the groove 13 of the lug 1. The belt 14 is raised in a position for carrying and the stirrup 8 is set in a position as shown in FIG. 1. The stirrup 8 enters the groove 13 of the lug 1 and abutts against the surface of the groove prevents spontaneous displacement of the latch 6 relative to the lug 1.

When the container 3 is carried, it is suspended on the belt and through the surface of the groove 13 presses on the stirrup 8 thus preventing disengagement of the latter from the groove, which, in turn, precludes spontaneous disengagement of the hook-like end of the latch 6 from the flange 11 of the cover 10.

Figure 3:
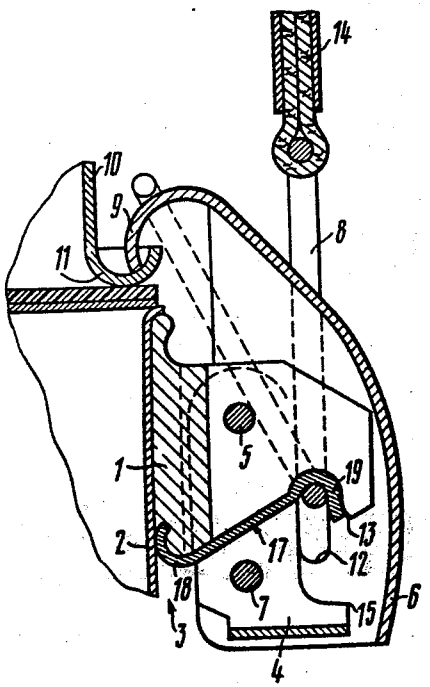
FIG. 3 is the same as in FIG. 1, and wherein the lock is provided with a resilient plate.

For more reliable fixing of the stirrup 8 in the groove 13 the lock according to another embodiment is provided with a resilient plate 17 /FIG. 3/. One end 18 of the plate 17 is fixed on the lug 1 and the other end 19 is bent in a loop and introduced into the groove 13. The stirrup 8 on being introduced into the groove 13 is pressed by the plate 17 and thereby is prevented from slipping out of the groove irrespective of the position of the belt 14 and the container.

For opening of the lock the stirrup 8 is turned down and disengaged from the resilient plate 17, the stirrup 8 moving in the slots 12 on the latch 6 up to the stop at the bottom wall of each slot /FIG. 3/.

The stirrup 8 is then pulled by means of the belt 14 to the right /as shown in the drawings/, and the latch 6 is turned in an anticlockwise direction relative to the hook-like end 9. In this case the latch 6 through the axle of the hinge 7 rotates the link 4 relative to the axle of the hinge 5. As a result the hook-like end 9 disengages the flange 11 of the cover 10.

Figure 4:
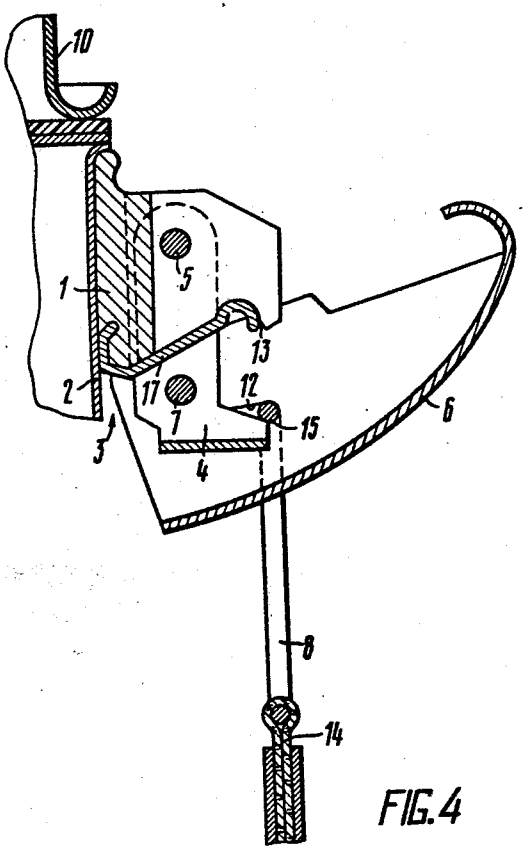
FIG. 4 is the lock for a portable container, shown in open position.

Thereafter the latch 6 is turned clockwise relative to the axle of the hinge 5 until the stirrup 8 abuts against the projection 15 of the link 4 as shown in FIG. 4. This done, the lock is open and the cover 10 can be easily removed from the body 2 of the container 3. The projection on the link 4 limits an outward movement of the latch 6, thereby preventing it from sinking behind the link 4 and knocking against the body of the container.

Spontaneous disengagement of the stirrup 8 from the groove 13 on the lug 1 can be prevented otherwise. For example, the dimensions of the stirrup 8 and of the latch 6 can be so selected that the first will embrace the latter in the longitudinal direction, i.e. in the direction of closing of the lock.

The inner size of the stirrup 8, which is the distance "1" between its opposite portions, is smaller than the outer size of the latch, which is a distance "$1_2$"—the shortest distance between the surface of the groove 13 on the lug 1 and the most distant point on the hook-like end 8 of the latch 6, by a value which is sufficient for the stirrup 8 to engage the hook-like end 9 with interference. The hook-like end 9 is engaged by the stirrup 8 by rotating the latter in the direction shown in FIG. 1 by an arrow. In this case the stirrup 8 elastically deforms the hook-like end 9 of the latch 6 and enters into the space between said hook-like end and the cover 10 of the container 3. The position of the stirrup 8 engaging the hook-like end 9 is shown in FIGS. 1 and 3 in dot line. For opening of the lock the stirrup 8 is disengaged from the hook 9 by pulling the belt 14 in a counterclockwise direction which is opposite to that shown by an arrow.

While the invention has been described herein in terms of the preferred embodiments, numerous variations may be made in the invention without departing from the spirit and the scope of the claims below.

We claim:

1. A lock for a container having a body with sidewalls and a cover, the lock comprising a lug mounted fixed to a sidewall of the container and having a transverse groove; a latch assembly mounted on said lug for releasably locking the cover on the container; said latch assembly comprising a link pivotally mounted on said lug, a latch pivotally mounted on the link and having a hooked end for engaging the cover and locking it on to the container body when the latch is pivoted in a direction to a position downwardly toward engaging said link and for releasing the cover when the latch is pivoted in a direction upwardly away from the link, the latch having longitudinal slots spaced from each other and disposed to lie in a plane in which said groove is disposed when the latch is positioned locking the cover on the container body, a stirrup movable in said slots for entering said transverse groove and maintaining the latch fixed relative to the lug to maintain the lock locked when the latch is disposed in the position for locking, and retaining means coactive with the stirrup for releasably maintaining the stirrup in the transverse groove.

2. A lock for a container having a body with sidewalls and a cover according to claim 1, in which said retaining means coactive with the stirrup comprises a strap connected thereto for carrying the container, and said strap pulling said stirrup into said groove while the container is supported from said strap.

3. A lock for a container having a body with sidewalls and a cover according to claim 1, in which said retaining means coactive with the stirrup comprises a resilient plate for releasably mounting the stirrup in said groove until purposely disengaged therefrom.

4. A lock for a container having a body with sidewalls and a cover according to claim 1, in which said link has a projection for acting as a stop for said stirrup when the lock is open.

5. A lock for a container having a body with sidewalls and a cover according to claim 1, in which retaining means comprises a strap connected to said stirrup for carrying said container, said strap moving a part of said stirrup to a position overlying said hook-like end of said stirrup, and said stirrup and said stirrup being relatively dimensioned to engage said hook-like end of said latch with interference.

6. A lock for a container having a body with sidewalls and a cover according to claim 1, in which said groove diverges toward an opening thereof for allowing guided entry of said stirrup thereinto.

* * * * *